US008672547B2

(12) United States Patent
Scutaro

(10) Patent No.: US 8,672,547 B2
(45) Date of Patent: Mar. 18, 2014

(54) MILK COVER

(75) Inventor: Joanne M Scutaro, Shoreham, NY (US)

(73) Assignees: Joanne M Scutaro, Shoreham, NY (US); Joseph Anthony Scutaro, Shoreham, NY (US)

( * ) Notice: Subject to any disclaimer, the term of this patent is extended or adjusted under 35 U.S.C. 154(b) by 36 days.

(21) Appl. No.: 13/526,624

(22) Filed: Jun. 19, 2012

(65) Prior Publication Data

US 2013/0039604 A1 Feb. 14, 2013

Related U.S. Application Data

(60) Provisional application No. 61/522,268, filed on Aug. 11, 2011.

(51) Int. Cl.
*B65D 33/28* (2006.01)
*B65D 23/06* (2006.01)
*B65D 23/00* (2006.01)

(52) U.S. Cl.
USPC ..... 383/75; 215/392; 215/394

(58) Field of Classification Search
USPC ..... 383/33, 43, 75, 118; 215/392–394
See application file for complete search history.

(56) References Cited

U.S. PATENT DOCUMENTS

| | | | | | |
|---|---|---|---|---|---|
| 1,446,563 | A * | 2/1923 | Hughes | 47/72 |
| 1,610,652 | A * | 12/1926 | Bouchard | 47/72 |
| 1,924,926 | A * | 8/1933 | Gray | 215/394 |
| 2,035,384 | A * | 3/1936 | Hinchliff | 66/170 |
| 2,115,654 | A * | 4/1938 | Swofford | 215/12.1 |
| 2,685,318 | A * | 8/1954 | Merkle | 215/395 |
| 2,990,968 | A * | 7/1961 | Pirman | 215/393 |
| 3,779,298 | A * | 12/1973 | Piccirilli et al. | 220/4.21 |
| 4,216,620 | A * | 8/1980 | Weder et al. | 47/72 |
| 5,799,820 | A * | 9/1998 | Maas | 220/739 |
| 6,477,804 | B2 * | 11/2002 | Weder et al. | 47/72 |
| D514,897 | S * | 2/2006 | Hoffman | D7/624.2 |
| 7,152,369 | B2 * | 12/2006 | Weder | 47/72 |

* cited by examiner

*Primary Examiner* — Jes F Pascua
(74) *Attorney, Agent, or Firm* — Limin Wen

(57) ABSTRACT

A liquid container cover is designed for a container which holds milk or other liquids and being stored in a refrigerator or other locations. Such cover, called "Milk Cover", can trap dried milk flakes, small spills or drips, and other particles to keep them from landing on the refrigerator shelf or other shelf. The Milk Cover has cotton or foam material version with cow-pattern design to hold different sizes or shapes of containers.

3 Claims, 3 Drawing Sheets

MILK COVER

REFERENCE TO RELATED APPLICATION

This application claims the benefit of the filing date of U.S. Provisional Application Ser. No. 61/522,268, entitled "MILK COVER" and filed on Aug. 11, 2011. The teachings of the entire referenced application are incorporated herein by reference.

FIELD OF THE INVENTION

This invention relates generally to covers for containers that store milk and other liquids that are stored in the refrigerator or other locations.

BACKGROUND OF THE INVENTION

Beverage spills and leakages in and around a kitchen will often present the problems of clean-up. This is especially true for refrigerators in a kitchen. Many times, a spill/drip or a leak from a beverage container in a refrigerator goes unnoticed until the user of the refrigerator desires the item which has been spilled or which has leaked. By the time the item is desired, the spill/drip or leak usually has solidified or has begun to solidify, leaving a hard to remove stain or residue on the refrigerator shelf. Therefore, there is a need in the art to provide an effective means for absorbing such spills in refrigerators. A beverage container cover may be used to substantially surround and/or cover a portion of a container in order to solve such problem.

SUMMARY OF THE INVENTION

The present invention relates generally to a cover for a container which holds milk or other liquids that are being stored in a refrigerator, cabinet or other location. Such cover traps dried milk flakes, small spills or drips, and other particles to keep them from landing on the refrigerator/cabinet/other storage shelf. It helps to keep the refrigerator/cabinet/other storage shelf clean from dried milk flakes, small spills/drips, and other particles.

In summary, the present invention solves a persistent problem of keeping the dried milk flakes, small spills, drips and other particles from landing on the refrigerator, cabinet or other shelf. It provides a novel, handy, simple, and stylish container cover, which is inexpensive and easy to manufacture.

DETAILED DESCRIPTION OF THE PREFERRED EMBODIMENTS

The preferred embodiments may be understood by referring to FIG. 1-7, which depict deferent views of the cow pattern-designed MILK COVER.

Figure 1:
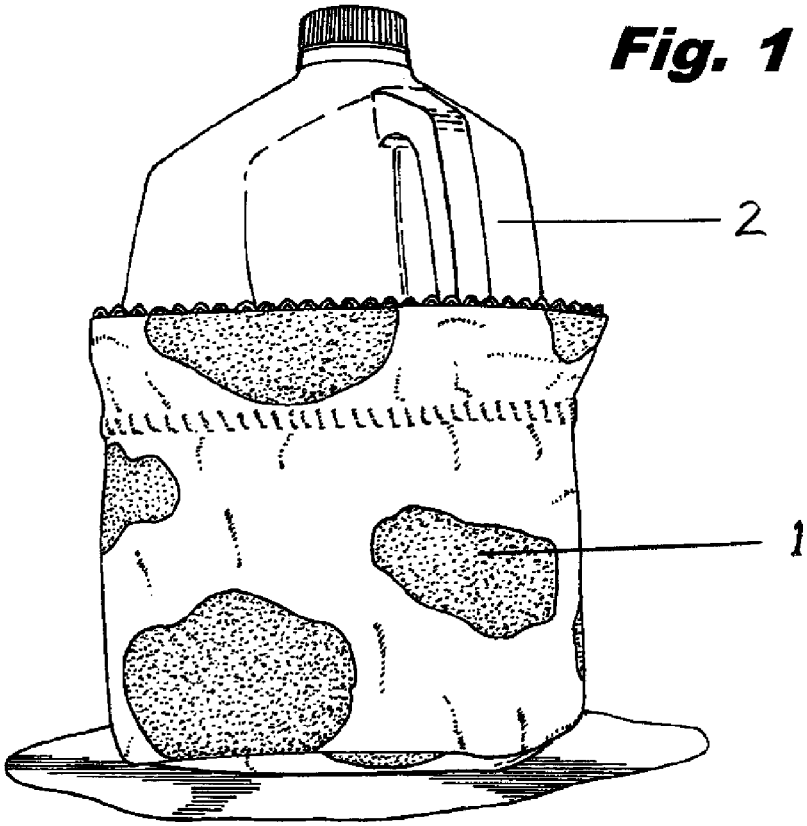
FIG. 1 presents a perspective view of the cow pattern-designed MILK COVER for a one-gallon round-shaped plastic container. This is the cotton material version of the present invention.
Figure 2:
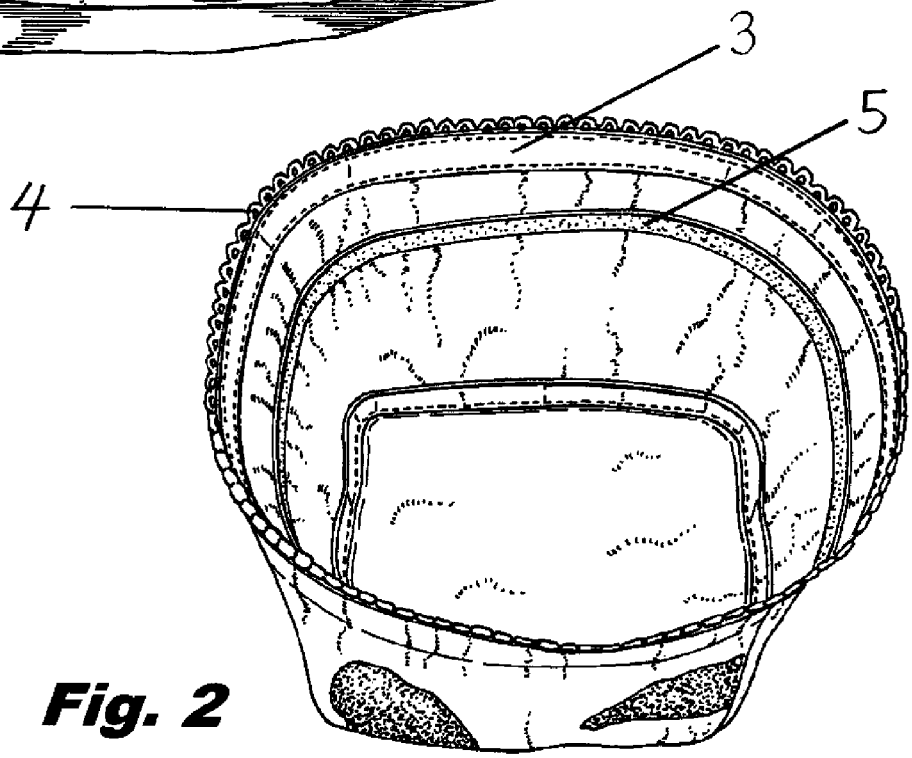
FIG. 2 presents a top plan view of the cow pattern-designed MILK COVER for a one-gallon round-shaped plastic container. This is also the cotton material version of the present invention.
Figure 3:
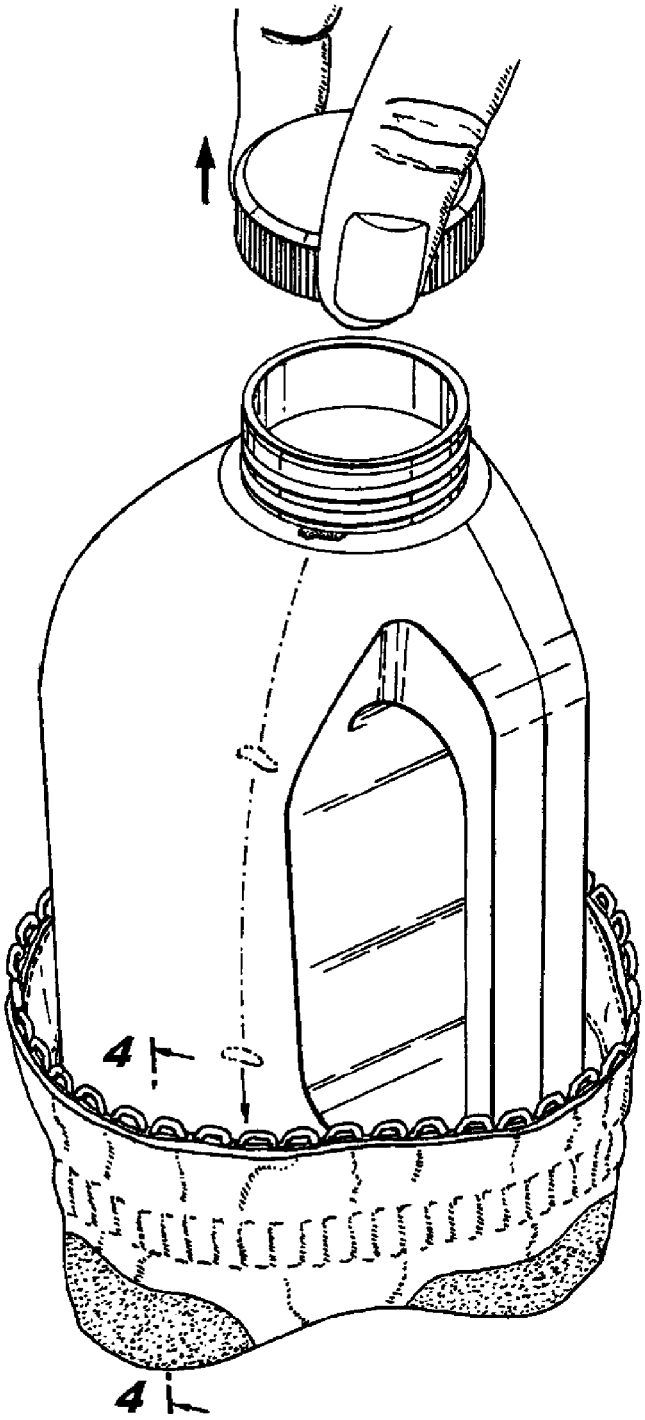
FIG. 3 presents a perspective view of the dried milk flakes or small spills or other particles from the top of the container falling into the MILK COVER.
Figure 4:
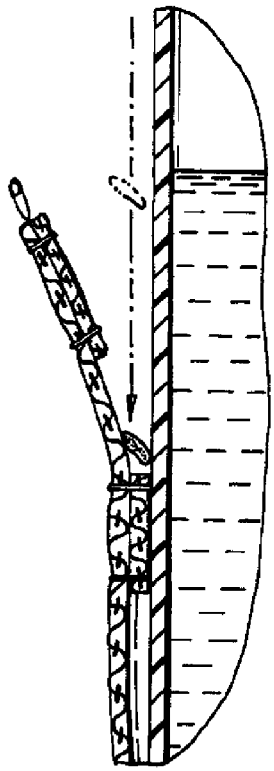
FIG. 4 presents a side view of the dried milk flakes or small spills or other particles from the top of the container falling into the MILK COVER.

In the drawing of FIG. 1, the said MILK COVER, a cotton material version of the present invention, comprises a round-shaped bag with black-and-white cow pattern design on it (1), a one-gallon milk plastic container (2) which is held by the said round-shaped bag. The said bag is designed according to the shape of the container, and then such container can be place into the bag smoothly with leaving a small space between the container and the bag. In the drawing of FIG. 2, there is an elastic band (3) surround the top opening with a lace (4) sawed with such elastic band. Also, there is another elastic band (5) under the first elastic band (3) which is close to the top opening. These two elastic bands (3, 5) are used to keep the bag to a certain shape for holding the container, with which it would be easier to put on or take off the cover. FIG. 2 also shows that the top opening of the bag is wider than the bottom of the bag, which allows some space between the bag and the container. Such small space is where the dried milk flakes and other particles would go instead of landing on the refrigerator shelf. This stops the dried milk flakes and other dirt particles from landing on the refrigerator shelf and helps to keep the refrigerator or other shelf clean. The cotton material milk cover also cleans the shelf as the milk is taken off the shelf and added back on the shelf. The milk cover is near form fitted with just a small space to capture the dried milk flakes and other dirt particles. FIG. 3 and FIG. 4 show how the dried milk flakes or small spills or other particles from the top of the container falling into the MILK COVER.

Figure 5:
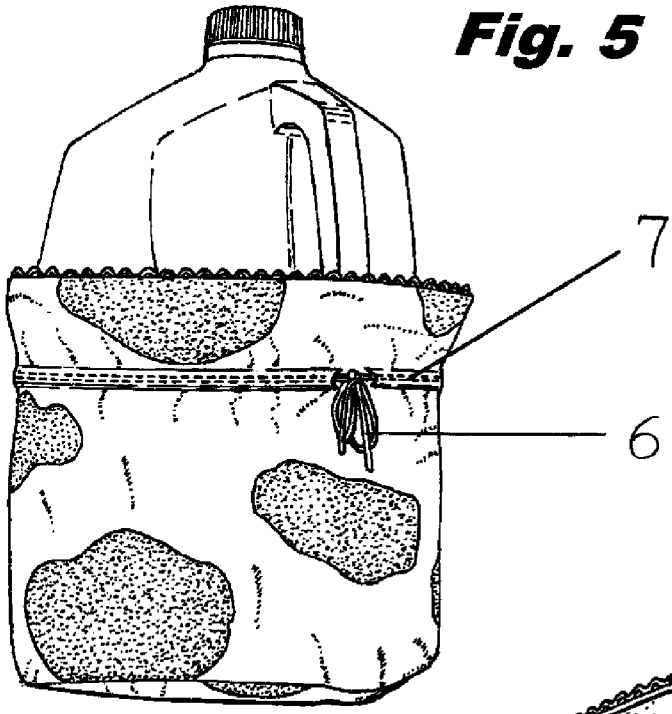
FIG. 5 presents a perspective view of the cow pattern-designed MILK COVER for a one-gallon round-shaped plastic container with string-tighten feature. This is also the cotton material version of the present invention.

In the drawing of FIG. 5, the said MILK COVER, a cotton material version of the present invention with cow pattern design for a one-gallon round-shaped plastic container, has a string-tighten feature. Such string (6) instead of the elastic band (5), located under the top opening of the bag and inside a channel (7) sawed surround the bag, is used to tight the bag to form some shape for holding the container and leave some space between the bag and the container.

Figure 6:
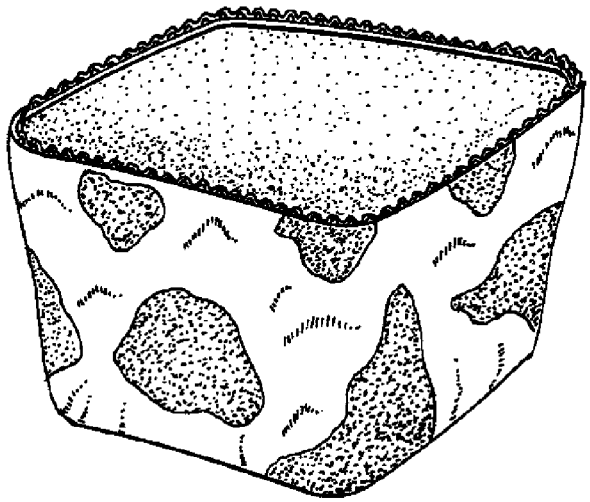
FIG. 6 presents a perspective view of the cow pattern-designed MILK COVER. This is the foam material version of the present invention.

In the drawing of FIG. 6, the said MILK COVER is a foam material version of the present invention with cow pattern design for a one-gallon plastic container. A one gallon plastic container can be placed in such foam milk cover leaving a small space between the one gallon container and the foam milk cover. This space is where the dried milk flakes and other particles would go instead of landing on the refrigerator shelf. This stops the dried milk flakes and other dirt particles from landing on the refrigerator shelf and helps to keep the refrigerator shelf clean. The foam milk cover also cleans the shelf as the milk is taken off the shelf and added back on the shelf. The cover is near form fitted with just a small space to capture the dried milk flakes and other dirt particles.

Figure 7:
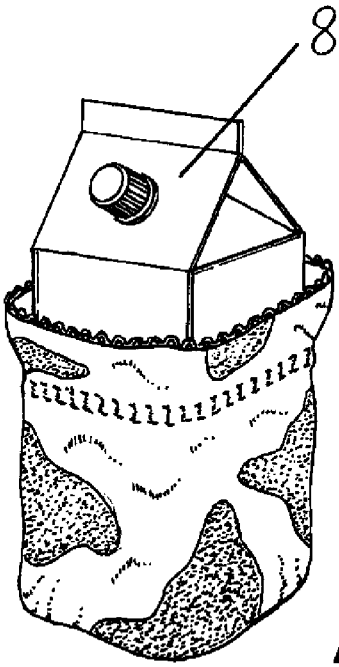
FIG. 7 presents a perspective view of the cow pattern-designed MILK COVER for a smaller square-shaped paper container. This is the cotton material version of the present invention.

In the drawing of FIG. 7, the said MILK COVER is a cotton material version of the present invention with cow pattern design for a smaller square-shaped paper container (8). Other features keep the same as shown in FIG. 1-4.

The measurements of the MILK COVER shown in FIG. 1-6 are for one gallon plastic containers. The MILK COVER can be adjusted proportionally for other sizes (i.e. other gallons, half gallons, pints, quarts, etc.), shapes (i.e. round, square, etc.), design (cow pattern, etc.), colors (black-and-white, etc.), and materials (i.e. cardboard, plastic). The cotton material version is machine washable. This MILK COVER can also be used for other liquids besides milk to help keep the refrigerator or other shelf clean. Such MILK COVER can be manufactured in various colors and designs for both the foam material version and cotton material version. In broad embodiment, the present invention allows milk or other liquid container to fit inside of it and cover the container slightly more than ½ way.

The main advantage of this present invention is to help keep the refrigerator or other shelf clean. It adds style to the containers and the added layer may help keep the milk or other liquid temperature longer when it has been removed from the refrigerator. It also adds style/design to the refrigerator or other shelf indeed.

Although the MILK COVER and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What is claimed is:

1. A liquid container cover for absorbing or collecting or trapping spills or drips of liquids, dried milk flakes, or other particles out of a liquid container comprises a bag, wherein said bag has an opening on the top of said bag and said opening is wider than the bottom of said bag, wherein there is a lace surround said opening on the top of said bag, wherein said bag has one elastic band attached inside said bag and around said opening on the top of said bag, wherein said bag has a string attached outside said bag and surround said bag, wherein said string is inserted into a channel attached outside said bag and surround said bag, wherein said string is located below said elastic band and above the middle of said bag.

2. A liquid container cover of claim 1, wherein said bag is made from fabric material.

3. A liquid container cover of claim 1, wherein said bag has a black and white cow-pattern design.

* * * * *